US005415390A

United States Patent [19]

Guerrero

[11] Patent Number: 5,415,390

[45] Date of Patent: May 16, 1995

[54] DOUBLE SURFACE REGISTRATION MECHANISM FOR A STACK OF SHEETS

[75] Inventor: Marco A. Guerrero, Guadalajara Jalisco, Mexico

[73] Assignee: Hewlett-Packard Company, Palo Alto, Calif.

[21] Appl. No.: 247,792

[22] Filed: May 23, 1994

[51] Int. Cl.[6] ..... B65H 43/04

[52] U.S. Cl. ..... 271/215; 271/217; 271/220; 271/236; 271/314

[58] Field of Search ..... 271/215, 217, 220, 221, 271/222, 234, 251, 184, 314; 267/156

[56] References Cited

U.S. PATENT DOCUMENTS

| | | | |
|---|---|---|---|
| 3,042,742 | 7/1962 | Foster | 267/156 |
| 4,589,654 | 5/1986 | Kenoto | 271/184 |
| 4,687,193 | 8/1987 | Scarabino et al. | 271/217 |
| 5,166,740 | 11/1992 | Tanahashi et al. | 271/220 |

FOREIGN PATENT DOCUMENTS

| | | | |
|---|---|---|---|
| 0045657 | 2/1982 | Japan | 271/234 |
| 0008160 | 1/1989 | Japan | 271/220 |
| 0261161 | 10/1989 | Japan | 271/220 |

*Primary Examiner*—H. Grant Skaggs

[57] ABSTRACT

A cut sheet stacking system receives and stacks cut sheets in registry against intersecting registration surfaces. The system comprises a sheet support surface, and first and second planar registration surfaces which extend upwardly from the sheet support surface and intersect to form a 90° angle of intersection therebetween. A roller having a flexible tab is rotatably mounted above the sheet support surface and is positioned to frictionally engage a topmost sheet of a stack on the sheet support surface. The roller/tab exerts a force on the topmost sheet in a direction that intersects the first and second planar registration surfaces at their point of intersection and, when rotated, imparts forces on the topmost sheet which directs it towards the intersecting first and second planar registration surfaces.

6 Claims, 2 Drawing Sheets

DOUBLE SURFACE REGISTRATION MECHANISM FOR A STACK OF SHEETS

FIELD OF THE INVENTION

This invention relates to mechanisms for arranging sheets in a stack and, more particularly, to such a mechanism which registers sheets in a stack against two registration surfaces.

BACKGROUND OF THE INVENTION

Copiers and printers are today called upon to interleave various jobs. Such jobs may require printing upon different sized sheets which are stacked in an output bin upon completion of the job. Many printers employ different output receptacles for different sized sheets to assure a neatly arranged stack upon the completion of a job. Other printers employ a single output receptacle for a print/copy job. Such single sized receptacle must be large enough to handle the largest size sheet employed during the print/copying process. It is desirable that like sized sheets be stacked in the output receptacle in registration so as to enable a neat stack to be removed from the receptacle, leaving larger/smaller sheet stacks in place.

Accordingly, it is an object of this invention to provide a registration mechanism which assures that sheets in a stack are registered against two intersecting registration surfaces.

It is another object of this invention to provide an improved sheet registration system which assures that different sized sheets are appropriately registered against intersecting registration surfaces.

It is yet another object to this invention to provide a sheet registration system which enables different sized stacks of sheets to be piled, one upon the other, with all sheets and all stacks being properly registered against intersecting registration surfaces.

SUMMARY OF THE INVENTION

A cut sheet stacking system receives and stacks cut sheets in registry against intersecting registration surfaces. The system comprises a sheet support surface, and first and second planar registration surfaces which extend upwardly from the sheet support surface and intersect to form a 90° angle of intersection therebetween. A roller having a flexible tab is rotatably mounted above the sheet support surface and is positioned to frictionally engage a topmost sheet of a stack on the sheet support surface. The roller/tab exerts a force on the topmost sheet in a direction that intersects the first and second planar registration surfaces at their point of intersection and, when rotated, imparts forces on the topmost sheet which directs it towards the intersecting first and second planar registration surfaces.

DETAILED DESCRIPTION OF THE INVENTION

Figure 1:
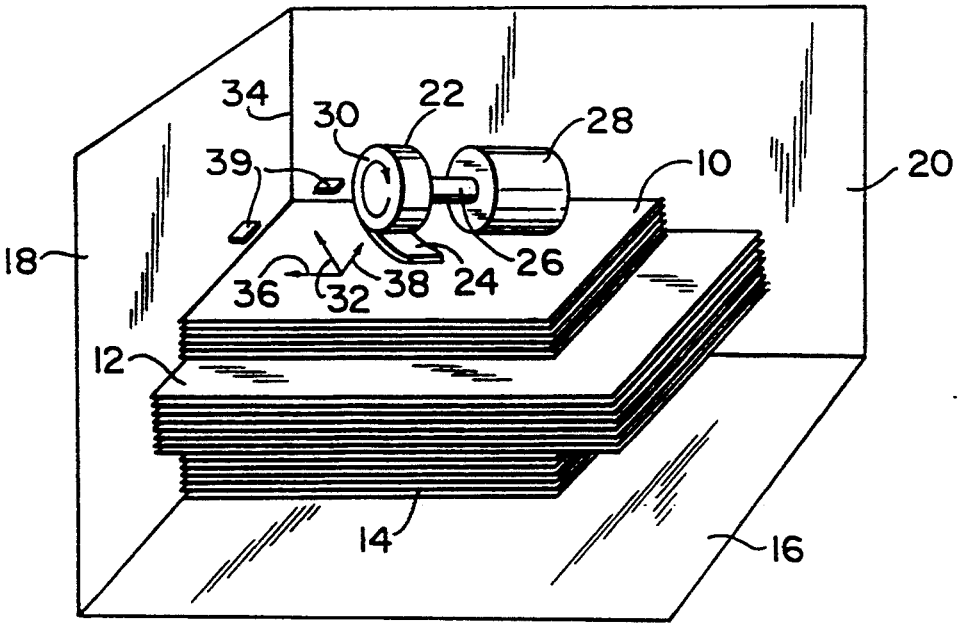
FIG. 1 is a schematic perspective view of a sheet stacking system employing the invention.

Referring to FIG. 1, a plurality of stacks of cut sheets 10, 12, 14 rest on a sheet support surface 16. A pair of planar registration surfaces 18 and 20 extend upwardly from sheet support surface 16 and provide registration surfaces against which individual sheets in stacks 10, 12 and 14 are to be positioned. A roller 22 includes an extended flexible tab 24 and is connected via a shaft 26 to a motor 28. Roller 22 and tab 24 are preferably comprised of a rubber compound. Shaft 26 and motor 28 are arranged so that the planar face 30 of rotor 22 is parallel to a vector 32 that bisects the 90° angle between registration surfaces 18 and 20. This arrangement assures, upon rotation of rotor 22 by motor 28, that flexible tab 24 will frictionally engage an uppermost sheet on stack 10 with a frictional force whose line of direction passes through intersection 34 between registration surfaces 18 and 20. Those skilled in the art will realize that the applied frictional force 32 is resolvable into two orthogonal components 36 and 38. Those force components cause a movement of the uppermost sheet of stack 10 towards registration surfaces 18 and 20 and assure an alignment thereof with respect thereto.

A pair of stops 39 extend from each of registration surfaces 18 and 20 and are positioned to prevent a topmost media sheet from curling at an edge and climbing a wall during rotation of roller 22.

Figure 2:
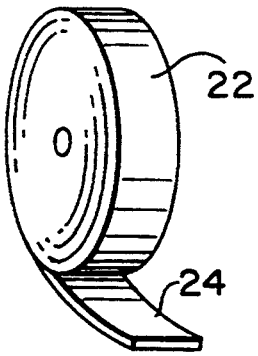
FIG. 2 is a perspective view of a roller/tab that is employed by the invention.

In FIG. 2, an expanded perspective view is shown of roller 22 and extended flexible tab 24. Flexible tab 24 extends outwardly from rotor 22 in a tangential manner so as to be able to flexibly move both towards and away from the external surface of roller 22, in accordance with the rotational speed thereof.

Figure 3:
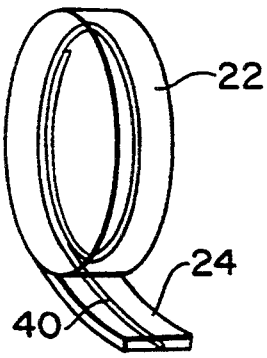
FIG. 3 is a transparent view of the roller/tab of FIG. 2, showing an internal stiffening member positioned therein.

In FIG. 3, a "transparent" view of roller 22 and extended flexible tab 24 is shown and illustrates the positioning therein of a preformed, curved stainless steel wire 40. Wire 40 provides a resilient metal core and a desired level of stiffness to extended flexible tab 24 and enables it to exhibit a predetermined amount of deflection, dependent upon the rotational speed of roller 22.

Figure 4A:
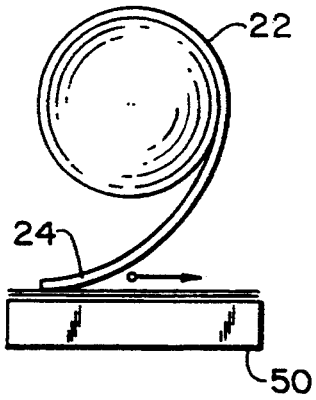
FIGS. 4*a*–4*c* illustrate how the tab portion of the roller/tab varies in accordance with the height of a stack.
Figure 4B:
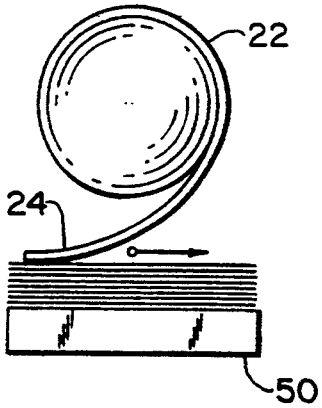
Figure 4C:
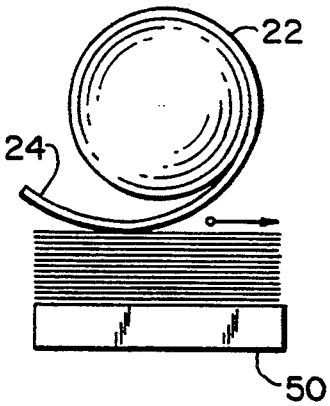

Roller 22 and extended flexible tab 24 provide a means which compensates for changes in the height of a stack of cut media sheets. As shown in FIGS. 4*a*–4*c*, as the height of a stack 50 increases, tab 24 is required to flex to a greater degree. However, due to the flexibility of tab 24, the frictional force increase is moderated, and does not substantially affect the registration operation.

Furthermore, when a topmost sheet of stack 50 is further away from roller 22, the speed of motor 28 (see FIG. 1) can be increased to increase the centrifugal force exerted upon extended flexible tab 24 so as to cause a bigger "unroll of the tab"—thereby giving it a further reach towards the topmost sheet.

Figure 5:
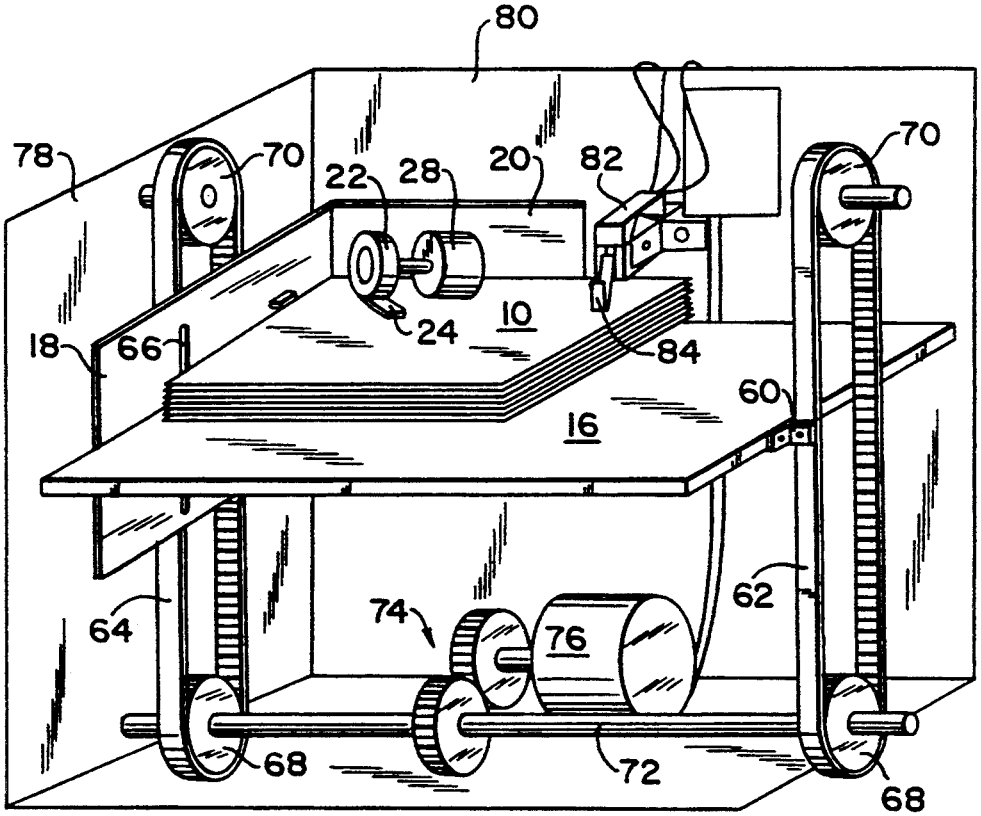
FIG. 5 is a schematic view of a sheet stacking mechanism that employs the invention hereof.

Turning to FIG. 5, a system is shown for enabling adjustment of the height of a stack in relation to rotor 22 and extended flexible tab 24. Sheet support surface 16 is connected via clips 60 (one is not shown) to opposed, toothed-belts 62 and 64. The hidden clip 60 runs up and down in a slot 66 within registration surface 18. Each of toothed belts 64 interacts with two toothed rollers 68 and 70, respectively. A shaft 72 drives rollers 68 and is in turn, driven through a gear arrangement 74 from a motor 76.

Each of registration surfaces 18 and 20 is fixed to external walls 78 and 80 so that sheet support surface 16 moves in relation thereto in a vertical manner. A microswitch 82 includes a flexible arm 84 which makes contact with a topmost sheet of stack 10. The operation of motor 76 is controlled by the operation of microswitch 82.

In an initial state, microswitch 82 is open and no power is applied to motor 76. As additional sheets are placed on stack 10, the height of the stack begins to increase, the additional sheets tending to move arm 84 in an upward direction. At a certain point, arm 84 causes switch 82 to close, applying power to motor 76 which rotates shaft 72 and causes sheet support 16 to move in a downward direction. This action causes arm 84 of microswitch 82 to eventually open again and to remove power from motor 76. The process repeats itself, as required, during the stacking of sheets to keep the distance between a topmost sheet of stack 10 and arm 84 substantially constant. In this manner, a continuous stacking process is enabled and maintains the top of stack 10 at a relatively constant distance from roller 22 and extended flexible tab 24. Roller 22 and extended tab 24 are thus enabled to maintain the sheets on stack in registration against planar registration surfaces 18 and 20.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A cut sheet stacking system for receiving and stacking cut sheets in registry against registration surfaces, said system comprising:

a sheet support surface; first and second planar registration surfaces extending upwardly from said sheet support surface and intersecting to form a ninety degree angle of intersection therebetween;

a roller and a flexible tab extending tangentially from said roller, both rotatably mounted above said sheet support surface, said flexible tab positioned to frictionally engage a topmost sheet of a stack on said sheet support surface and to exert a force on said topmost sheet in a direction that intersects said first and second planar registration surfaces at their intersection;

a stop extending from at least one registration surface for preventing a curled sheet from moving up a registration surface when impelled by said flexible tab; and motor means for rotating said roller and flexible tab so as to register said topmost sheet against both said registration surfaces.

2. A cut sheet stacking system as recited in claim 1 wherein a resilient metal core is positioned within said roller and within said flexible tab.

3. A cut sheet stacking system as recited in claim 2 wherein said roller and flexible tab are comprised of a rubber based material.

4. A cut sheet stacking system as recited in claim 1 wherein said force is exerted in a direction that bisects said angle of intersection between said first and second planar registration systems.

5. The cut sheet stacking system as recited in claim 1 wherein said motor means operates said roller at a higher speed when said topmost sheet is further away from said roller to cause additional outward flexure of said flexible tab so as to bring said flexible tab into contact with said top sheet.

6. The cut sheet stacking system as recited in claim 5 further comprising:

means for moving said sheet support surface in a vertical direction;

detector means for determining when a stack of sheets reaches a predetermined distance from said flexible tab means and for issuing signal in response thereto; and control means responsive to said signal to operate said means for moving to move said sheet support surface away from said flexible tab means by a distance, said distance still enabling said flexible tab means to engage a topmost sheet of said stack.

* * * * *